US010688498B2

(12) United States Patent
Kendel et al.

(10) Patent No.: US 10,688,498 B2
(45) Date of Patent: Jun. 23, 2020

(54) BEATER WHEEL FOR PULVERIZER MILL AND METHOD OF ASSEMBLY

(71) Applicant: General Electric Technology GmbH, Baden (CH)

(72) Inventors: Friedemann Kendel, Stuttgart (DE); Tim Buhl, Stuttgart (DE); Steven Michael Stannard, Stuttgart (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 373 days.

(21) Appl. No.: 15/812,284

(22) Filed: Nov. 14, 2017

(65) Prior Publication Data

US 2019/0143336 A1 May 16, 2019

(51) Int. Cl.

| | |
|---|---|
| ***B02C 13/00*** | (2006.01) |
| ***B02C 13/06*** | (2006.01) |
| ***B02C 13/28*** | (2006.01) |
| ***B02C 13/13*** | (2006.01) |
| *B02C 23/32* | (2006.01) |
| *B02C 23/12* | (2006.01) |

(52) U.S. Cl.

CPC ..... *B02C 13/06* (2013.01); *B02C 13/13* (2013.01); *B02C 13/2804* (2013.01); *B02C 23/12* (2013.01); *B02C 23/32* (2013.01)

(58) Field of Classification Search

CPC ..... B02C 18/06; B02C 13/2804; B02C 13/13; B02C 23/32; B02C 23/12

See application file for complete search history.

(56) References Cited

U.S. PATENT DOCUMENTS

| | | | | |
|---|---|---|---|---|
| 3,938,962 | A * | 2/1976 | Feilbach, Jr. | B02C 13/2804 428/554 |
| 3,955,767 | A * | 5/1976 | Hise | B02C 13/1814 241/275 |
| 4,690,341 | A * | 9/1987 | Hise | B02C 13/1842 241/275 |
| 6,269,559 | B1 * | 8/2001 | Edwards | A01B 33/103 144/24.12 |
| 6,360,894 | B1 * | 3/2002 | Devlin | B07B 1/22 209/291 |
| 6,554,215 | B1 * | 4/2003 | Schultz | B02C 13/1835 241/275 |

(Continued)

FOREIGN PATENT DOCUMENTS

| | | |
|---|---|---|
| DE | 1 164 213 B | 2/1964 |
| DE | 1 173 316 B | 7/1964 |

(Continued)

*Primary Examiner* — Faye Francis
(74) *Attorney, Agent, or Firm* — Grogan, Tuccillo & Vanderleeden, LLP

(57) ABSTRACT

A beater wheel for a pulverizer mill is provided. The beater wheel includes a rotatable hub disc having apertures defined therethrough and a ring disc having respective apertures defined therethrough, and a plurality of tubular ribs, disposed therebetween and weldingly coupled thereto at a tubular first end to the hub disc and at a tubular second end to the ring disc to define respective weld joints thereat. Each respective aperture in the hub disc and ring disc are sized and disposed to allow direct access therethrough to at least one respective weld joint at the respective interior surface of the first and second tubular ends for inspection and testing.

20 Claims, 8 Drawing Sheets

(56) References Cited

U.S. PATENT DOCUMENTS

| | | | | |
|---|---|---|---|---|
| 7,810,531 | B2 * | 10/2010 | Labbe | A01G 23/00 144/231 |
| 7,942,357 | B2 * | 5/2011 | Dallimore | B02C 13/1835 241/275 |
| 7,967,044 | B2 * | 6/2011 | Labbe | A01G 23/093 144/172 |
| 8,025,247 | B2 * | 9/2011 | Dallimore | B02C 13/1835 241/275 |
| D750,142 | S * | 2/2016 | Suzuki | D15/138 |
| 9,914,128 | B2 * | 3/2018 | Hackworth | B02C 13/1835 |
| 2015/0014458 | A1 * | 1/2015 | Pfoltner | A01B 33/103 241/101.742 |

FOREIGN PATENT DOCUMENTS

| | | |
|---|---|---|
| DE | 27 33 133 A1 | 2/1979 |
| DE | 196 22 913 A1 | 12/1997 |
| DE | 196 22 914 A1 | 12/1997 |
| DE | 100 53 652 A1 | 5/2002 |
| DE | 102 05 240 A1 | 8/2003 |

* cited by examiner

BEATER WHEEL FOR PULVERIZER MILL AND METHOD OF ASSEMBLY

FIELD OF THE INVENTION

Embodiments of the invention relate generally to beater wheels for pulverizer mills, also referred to hereinafter simply as "mills," or "beater wheel mills", and more specifically, to a device and method for assembling a beater wheel for a pulverizer mill.

BACKGROUND OF THE INVENTION

Beater wheel mills are typically used for the comminution of solid fuels, such as brown coal, into particles having a grain size that is suitable for combustion, for example in the furnace of a power plant.

For example, one such type of pulverizer mill is a coal dust fan mill which grinds and conditions coal into carbon dust for the subsequent conveyance of the carbon dust into the coal dust firing of steam generators. The comminution of raw coal in such a coal dust fan mill is accomplished by a rapidly rotating beater wheel that crushes the coal fed thereto. The coal is fed into a circumferential rim region of the beater wheel and is comminuted by beater plates coupled to the beater wheel. The beater wheel typically consists of a beater wheel hub disc and a beater wheel ring disc as well as webs, or ribs, which are inserted therebetween along the radially outer part of the beater wheel hub disc and the beater wheel ring disc and bolted thereto. The beater plates are arranged on the ribs, and may be arranged as a single or a multiple part beater plate set corresponding to each rib.

As a consequence of low-NOx combustion of lignite in modern power plants, the air distribution between mill air and burner air has been shifted to increase burner air (otherwise known as secondary air), and consequently to decrease mill air (otherwise known as primary air), thus leading to lower emission values and a better environmental performance. However, the reduction of primary air in the mill decreases cooling within the mill and consequently increases the temperature loading of the mill. The operating temperatures in typical beater wheel mills can exceed 300 deg. C, and the temperatures at the bolted connections can often exceed 450 deg. C.

In conventional beater wheels, the hub disc, ring disc, webs, and bolts are fabricated using heat-resistant steel or steel castings. Due to the material properties of the steel, the bolts used in conventional beater wheel mills may tend to exhibit creep at the high operating temperatures typically reached within the mill. Additionally, in combination with a relatively low pretension of the bolted connection, due to weakness of material pairs, an undesired loss of pretension after a certain operation period may also occur. Moreover, in the high temperature environment of a mill, gaps may gradually form in the bolted connections. Such gaps may, in some cases, be large enough to collect coal dust therein, promoting further plastic deformation of the structure.

What is needed, therefore, is an improved beater mill wheel and method for assembling a beater wheel for a pulverizer mill.

SUMMARY OF THE INVENTION

In an embodiment, a beater wheel for a pulverizer mill is provided. The mill comprises a hub disc and an opposing ring disc facing the hub disc, with a plurality of ribs disposed therebetween, each rib being welded at opposing ends to the hub disc and to the ring disc. The hub disc defines a first inboard face and an a first outboard face opposite the first inboard face, the hub disc also having a first plurality of apertures defined therethrough, each aperture of the first plurality of apertures defining a respective first inboard rim thereabout on the first inboard face. The ring disc is spaced therefrom the hub disc, and defines a second inboard face and a second outboard face and opposite the second inboard face, the second inboard face facing the first inboard face and spaced therefrom. The ring disc also has a second plurality of apertures defined therethrough, each aperture of the second plurality of apertures defining a respective second inboard rim thereabout on the second inboard face. Additionally, each rib of the plurality of ribs has a first end and an opposing second end, wherein, each first end of each rib of the plurality of ribs is weldingly coupled to a respective first inboard rim to define a respective first joint therebetween, and each opposing second end of each rib of the plurality of ribs is weldingly coupled to a respective second inboard rim to define a respective second joint therebetween.

In another embodiment, a method of assembling a pulverizer wheel is provided. The method includes: providing a hub disc having a first inboard side including a hub disc inboard face, and a first outboard side comprising a first outboard face opposite the first inboard side, the hub disc including a plurality of hub disc apertures defined therethrough, each hub disc aperture defining a respective hub disc inboard rim thereabout disposed on the inboard face of the respective hub disc. The method further includes providing a ring disc having a second inboard side that includes a ring disc inboard face, and a second outboard side opposite the second inboard side, the ring disc including a plurality of ring disc apertures defined therethrough, each ring disc aperture defining a respective ring disc inboard rim thereabout disposed on the inboard face of the respective ring disc. Additionally, the method includes arranging the first inboard side of the hub disc to face the second inboard side of the ring disc, providing a plurality of ribs, each rib of the plurality of ribs having a tubular first end and a tubular second end opposite the tubular first end, welding each tubular first end of each rib to a respective hub disc inboard rim on the hub disc first inboard side to define a corresponding first welded joint between the respective hub disc inboard rim and the corresponding rib; welding the respective tubular second end of each rib to a respective ring disc inboard rim on the ring disc second inboard side to define a corresponding second welded joint between the respective ring disc inboard rim and the corresponding rib.

The method further includes accessing, from the hub disc first outboard side through the respective hub disc aperture, the corresponding first welded joint between the hub disc inboard rim and a first inner surface of the first tubular end of the corresponding rib, and accessing, from the ring disc second outboard side through the respective ring disc aperture, the corresponding second welded joint between the ring disc inboard rim and a second inner surface of the second tubular end the corresponding rib.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
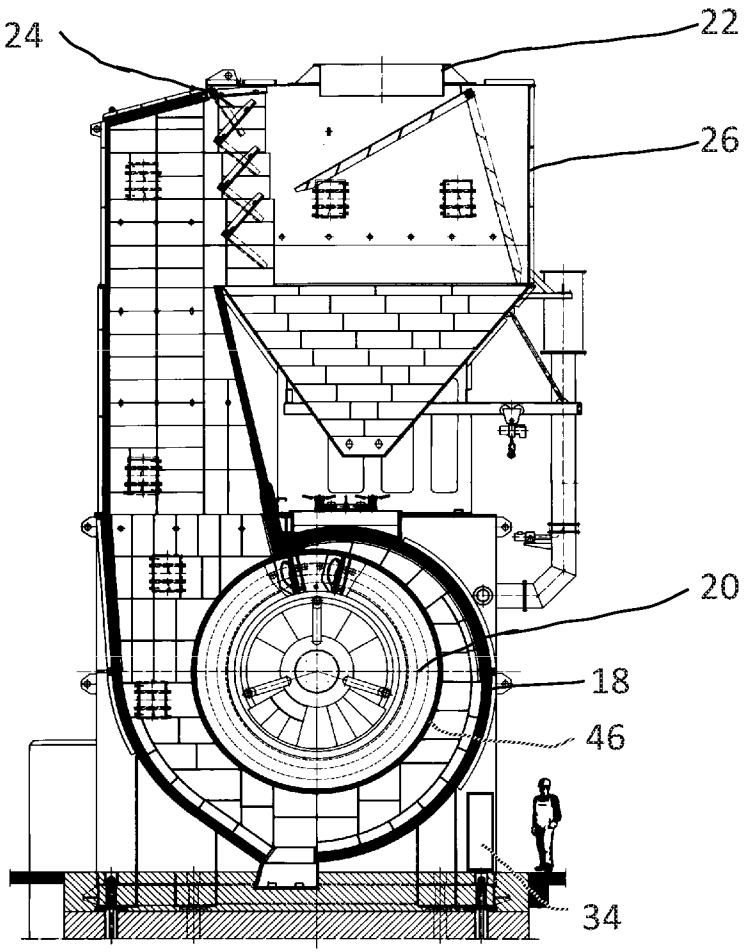
FIG. 1 is a cross-section view of a pulverizer mill, in accordance with an embodiment of the invention.

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. As used herein, "coupled," and "connected," mean that the referenced elements are directly or indirectly connected and intervening components may be present. Accordingly, the terms "upstream" and "downstream," as used herein, describe the position of the referenced elements with respect to a flow path such as of a fluid and/or gas flowing between and/or near the referenced elements.

Additionally, while the embodiments disclosed herein are primarily described with respect to pulverizer mills, e.g., vertical spindle pulverizer mills, for solid fuel-based power plants, e.g., coal-based power plants, it is to be understood that embodiments of the present invention may be applicable to other apparatus and/or methods that benefits from the teachings herein.

Figure 2:
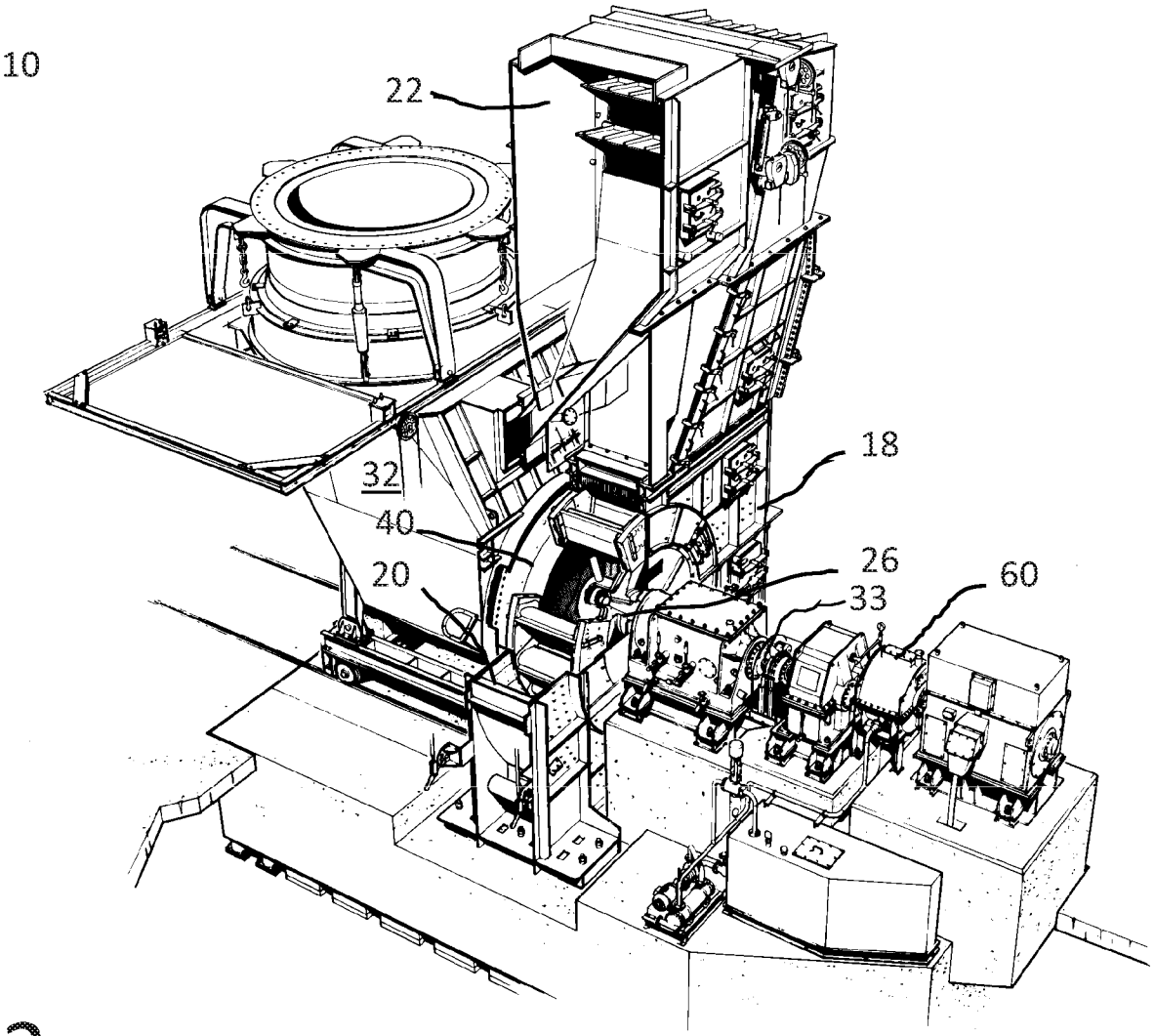
FIG. 2 is a perspective view, with partial cut-away, of the pulverizer mill of FIG. 1, in accordance with an embodiment of the invention.

Referring now to FIGS. 1 and 2, a pulverizer mill 10 in accordance with embodiments of the invention, is shown. The pulverizer mill 10 includes a housing 18, a fuel inlet duct 20, one or more fuel outlet ducts 22, a rotatable beater wheel 40 is supported by a shaft 26 turned by a motor 60, one or more air inlet ducts 28, a classifier 32, and a controller 34 that may include at least one processor/CPU and a memory device (not shown). The housing 18 contains the classifier 32 and the rotatable beater wheel 40. The fuel inlet duct/pipe 20, the fuel outlet ducts 22, and the air inlet ducts 28 penetrate the housing 18 as shown in FIGS. 1 and 2.

As will be understood, during operation of the pulverizer mill 10, in accordance with embodiments of the invention, the beater wheel 40 is rotated at high speed to grind particles of the material (not shown), e.g., coal, other solid fuels, and/or other materials suitable for being pulverized by the beater wheel 40 fed thereto via the fuel inlet duct 20. The motor 60 is operated to rotate the axle 60 thereby rotating the beater wheel 40. As the beater wheel 40 rotates, the material (not shown) centrifugally flows towards an outer edge or circumference 46 of the wheel 40 enables the grinder 40 to crush/pulverize the particles of the material 42 in a conventional manner. The air inlet ducts 28 blow forced air up through the housing 18 such that pulverized material (not shown) is forced toward an upstream side of the classifier 32 which allows fine particles of the material to flow toward a downstream side of the classifier 32. As will be understood, the upstream side of the classifier 32 is the side of the classifier 32 that is exposed to the interior of the housing 18 and the downstream side of the classifier 32 is the side of the classifier 32 that is exposed or fluidly connected to the fuel outlet ducts 22. Thus, as will be appreciated, the classifier 32 allows a stream of fine particles of the material flow through the classifier 32 and into the outlet ducts 22 for subsequent consumption or combustion by a furnace, such as a boiler (not shown), or other process that consumes the pulverized material, while restricting the flow of coarse particles from the upstream side to the downstream side of the classifier 32.

Figure 4:
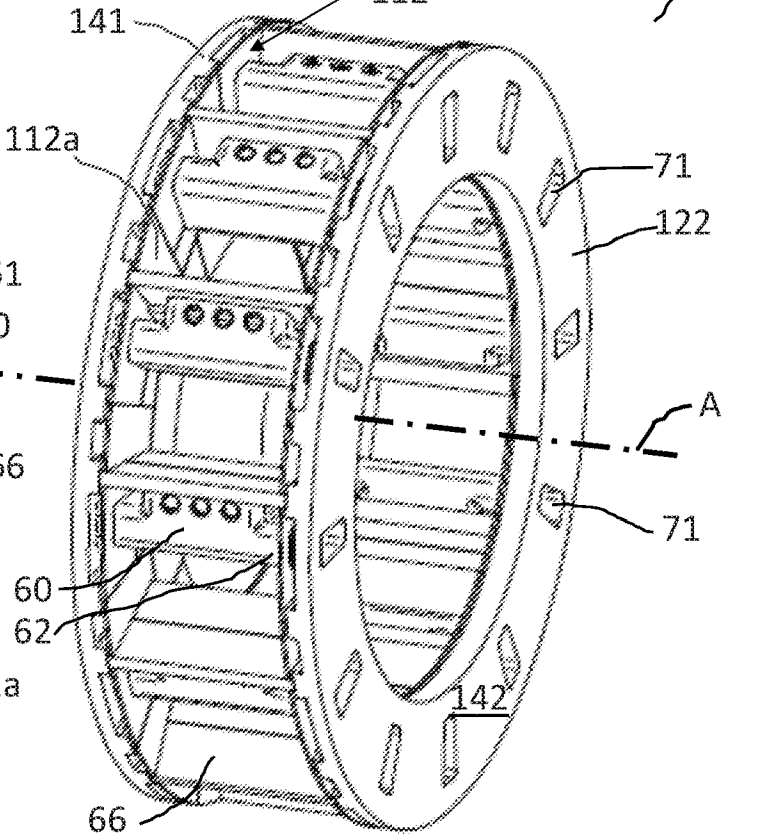
FIG. 4 is another perspective view of the beater wheel of FIG. 3.
Figure 3:
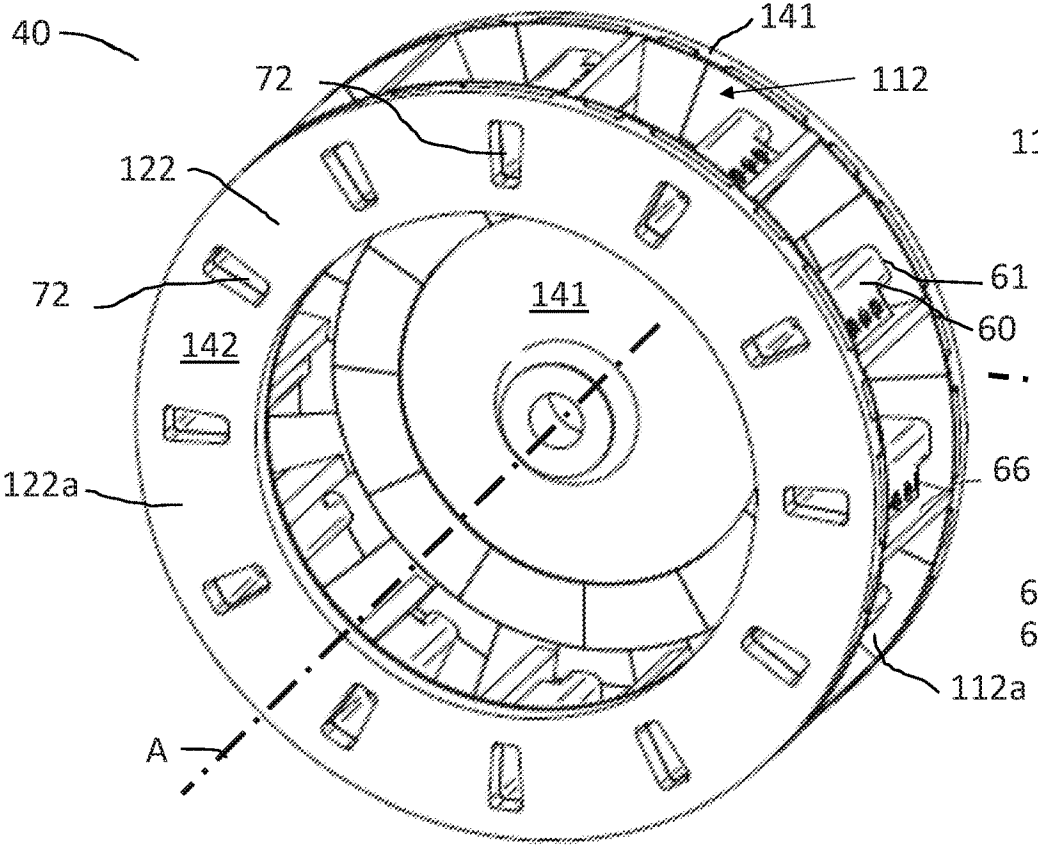
FIG. 3 is perspective view of a beater wheel, in accordance with an embodiment of the invention.
Figure 5:
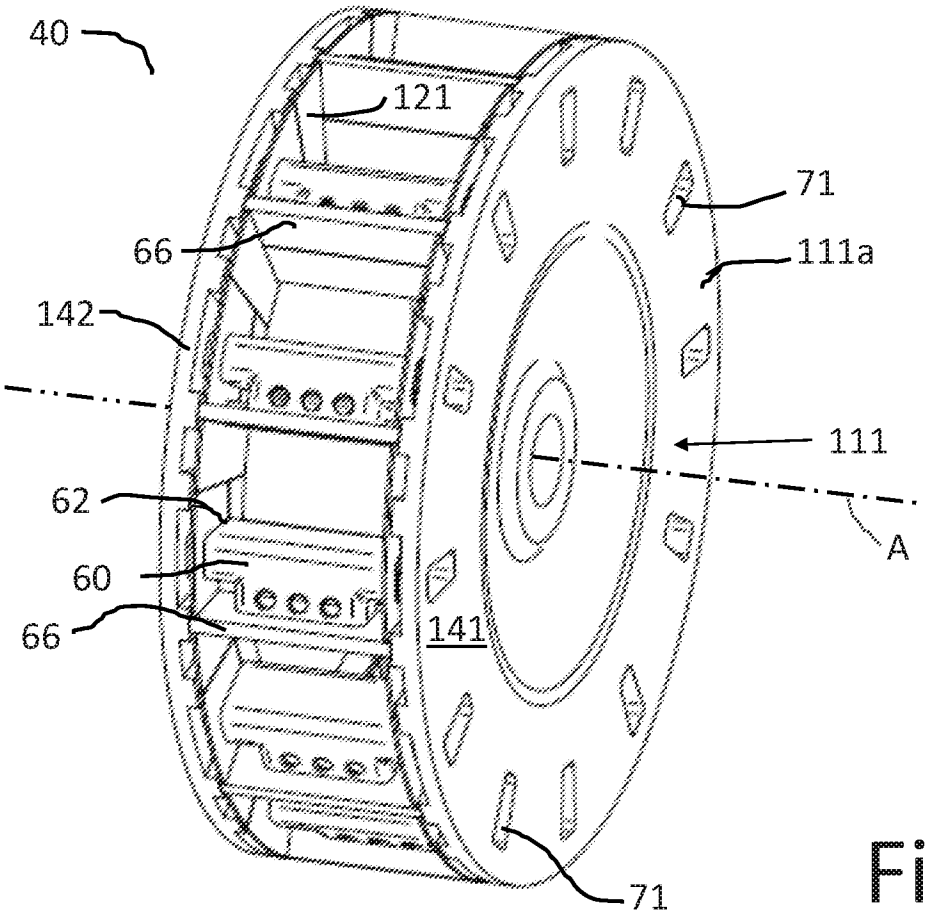
FIG. 5 is yet another perspective view of the beater wheel of FIG. 3.

Turning now to FIGS. 3-5, wherein various perspective views of the beater wheel 40 of FIG. 2 is shown. The beater wheel 40 includes a hub disc 141 and a ring disc 142. The hub disc 141 is coupled to and spaced from a ring disc 142, and defines a first inboard side 112 disposed to face the ring disc 142. In an embodiment, the hub disc first inboard side 112 defines a hub disc inboard face 112*a*. The hub disc 141 also includes a first outboard side 111 opposite the first inboard side 112. In an embodiment, the hub disc first outboard side 111 defines a first outboard face 111*a*. The ring disc 142 has second inboard side 121 which is operatively disposed to face the hub disc first inboard side 112. In an embodiment, the second inboard side 121 of the ring disc 142 defines a ring disc inboard face 121*a*. The ring disc 142 also has a second outboard side 122 opposite the second inboard side 121. In an embodiment, the second outboard side 122 defines a second outboard face 122*a*.

As noted above, the hub disc 141 may be rigidly coupled to a rotatable shaft or axle 33 (FIG. 2). The axle 33 defines a longitudinal axis of rotation "A", and as will be appreciated, rotation of the axle 33 thereby causes rotation of hub disc 141 and ring disc 142 about the axis of rotation "A". The hub disc 141 and ring disc 142 are thus operative to rotate about a common axis "A", in a common direction. For example, the hub disc 141 and ring disc 142 may be arranged to commonly rotate in a clockwise or counter-clockwise direction about axis "A" and at the same speed.

Figures 6, 6A, 6B:
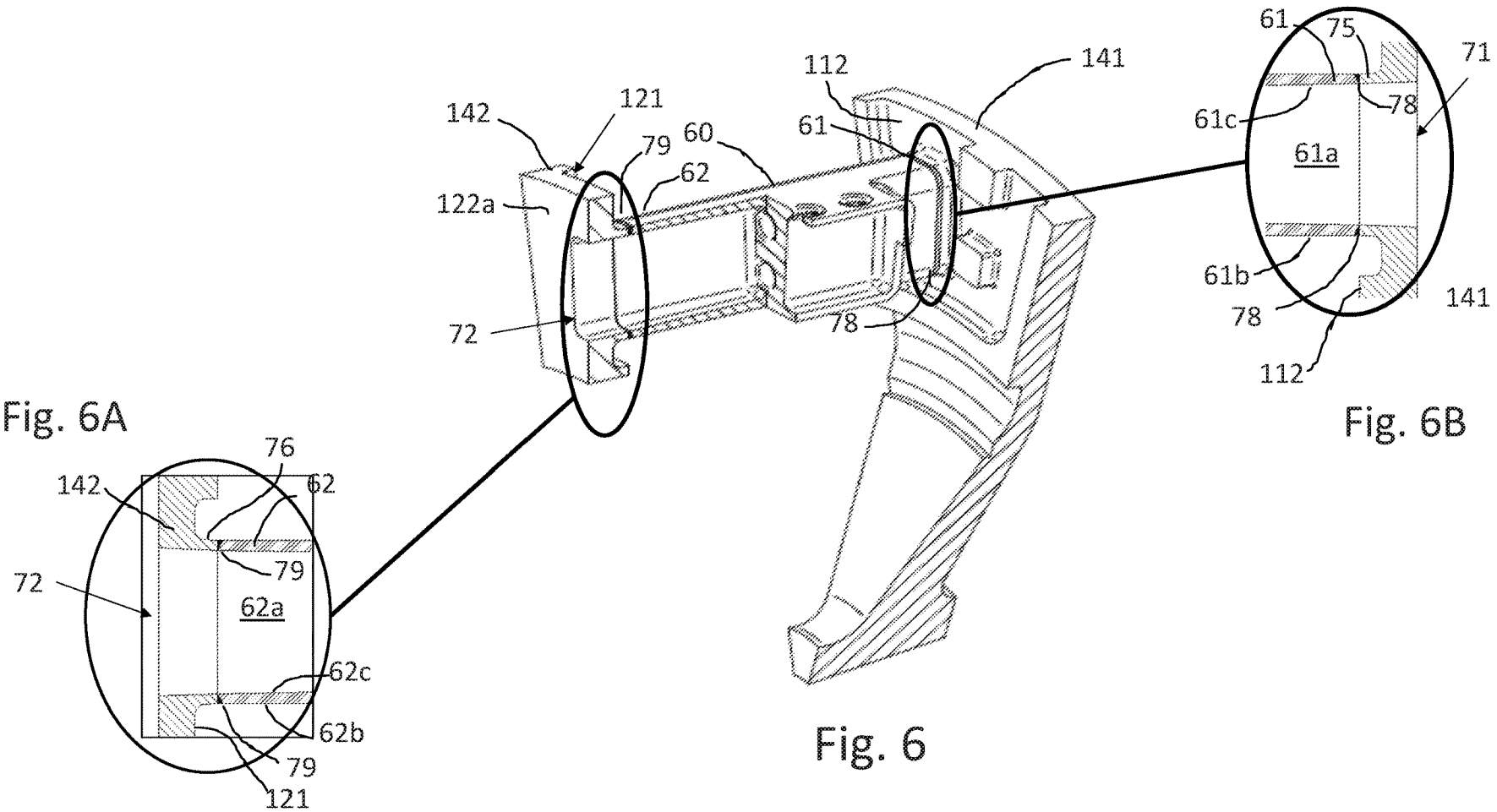
FIG. 6 is a partial perspective view, in partial cross-section, of a beater wheel, in accordance with an embodiment of the invention.
FIG. 6*a* is a cross-sectional detail view of a portion of the beater wheel of FIG. 6.
FIG. 6*b* is cross-sectional detail view of a another portion of the beater wheel of FIG. 6.

With additional reference now to FIGS. 6, 6*a*, and 6*b*, a plurality of web elements or ribs 60 are disposed between, and coupled thereto, hub disc 141 and ring disc 142. Each rib 60 has a first end 61 and a second end 62 opposite the first end 61. For example, the first end 61 of each rib 60 is welded to the hub disc 141 first inboard side 112, and the respective second end 61 of each rib is welded to the ring disc 142 second inboard side 121. In an embodiment, the plurality of ribs 60 is radially distributed around a circumference of the beater wheel 40 at regular intervals.

In an embodiment, the first end 61 and second end 62 of each rib 60 may each define a respective end formed as a tube which is weldingly coupled to the corresponding hub 141 and ring disc 142. For example, in an embodiment, each rib 60 may have a first tubular end 61*a* and an opposing second tubular end 62*a*, the first tubular end 61*a* being of tubular construction and defining a first outer tube surface 61*b* thereon and a first inner tube surface 61*c* therein. In an embodiment, the opposing second tubular end 62*a* is of tubular construction and further defines a second outer tube surface 62*b* thereon and a second inner tube surface 62*c* therein. For example, the first and second tubular ends 61*a*, 62*a* may each be constructed in the form of a hollow tube, wherein the first and second outer surfaces 61*b*, 62*b*, define the respective tube outer walls, and the first and second inner surfaces 61*c*, 62*c*, define the respective tube inner walls.

Figure 7:
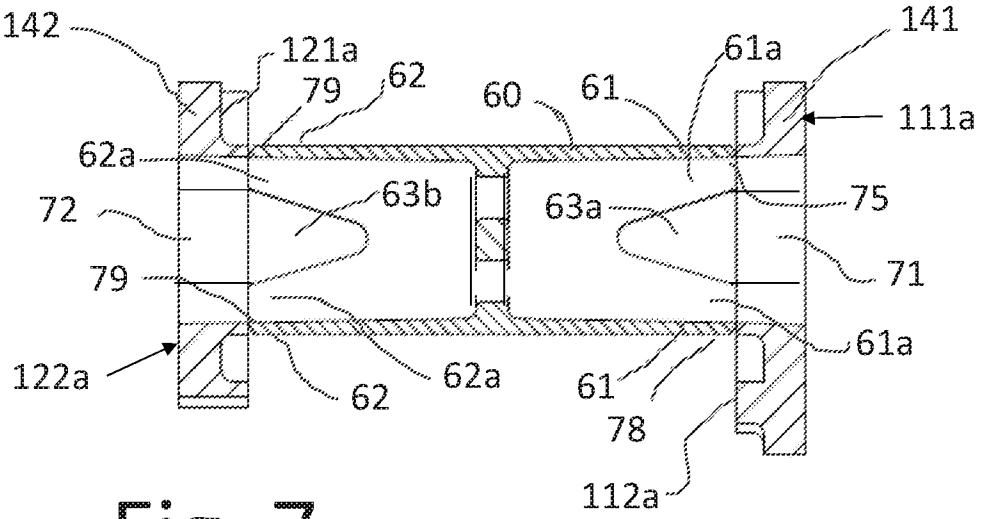
FIG. 7 is a cross-sectional view of a portion of a beater wheel in accordance with an embodiment.
Figure 8:
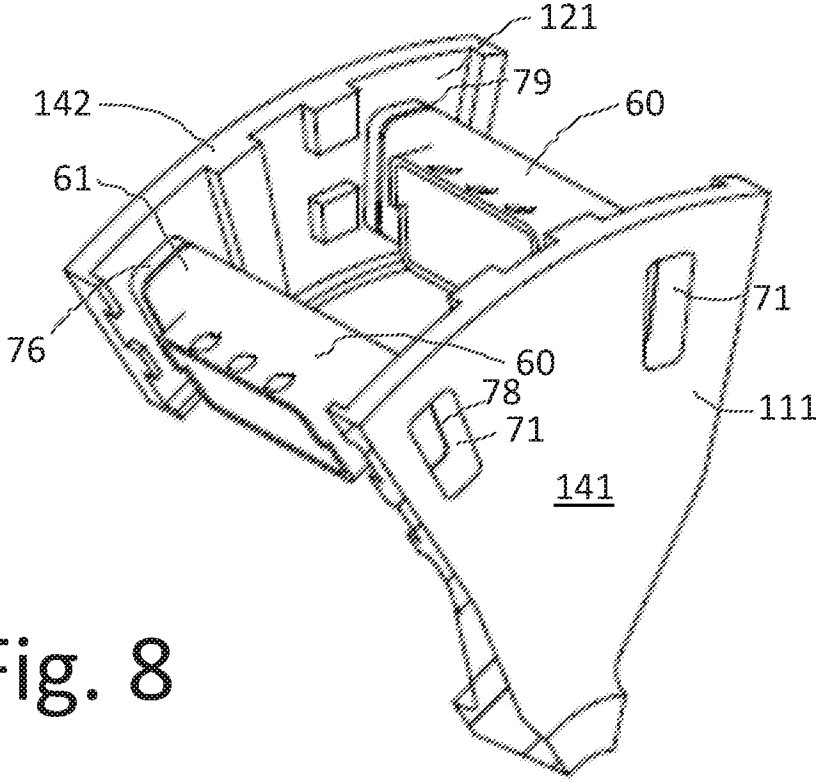
FIG. 8 is a perspective view of a portion of a beater wheel, in accordance with an embodiment.
Figure 9:
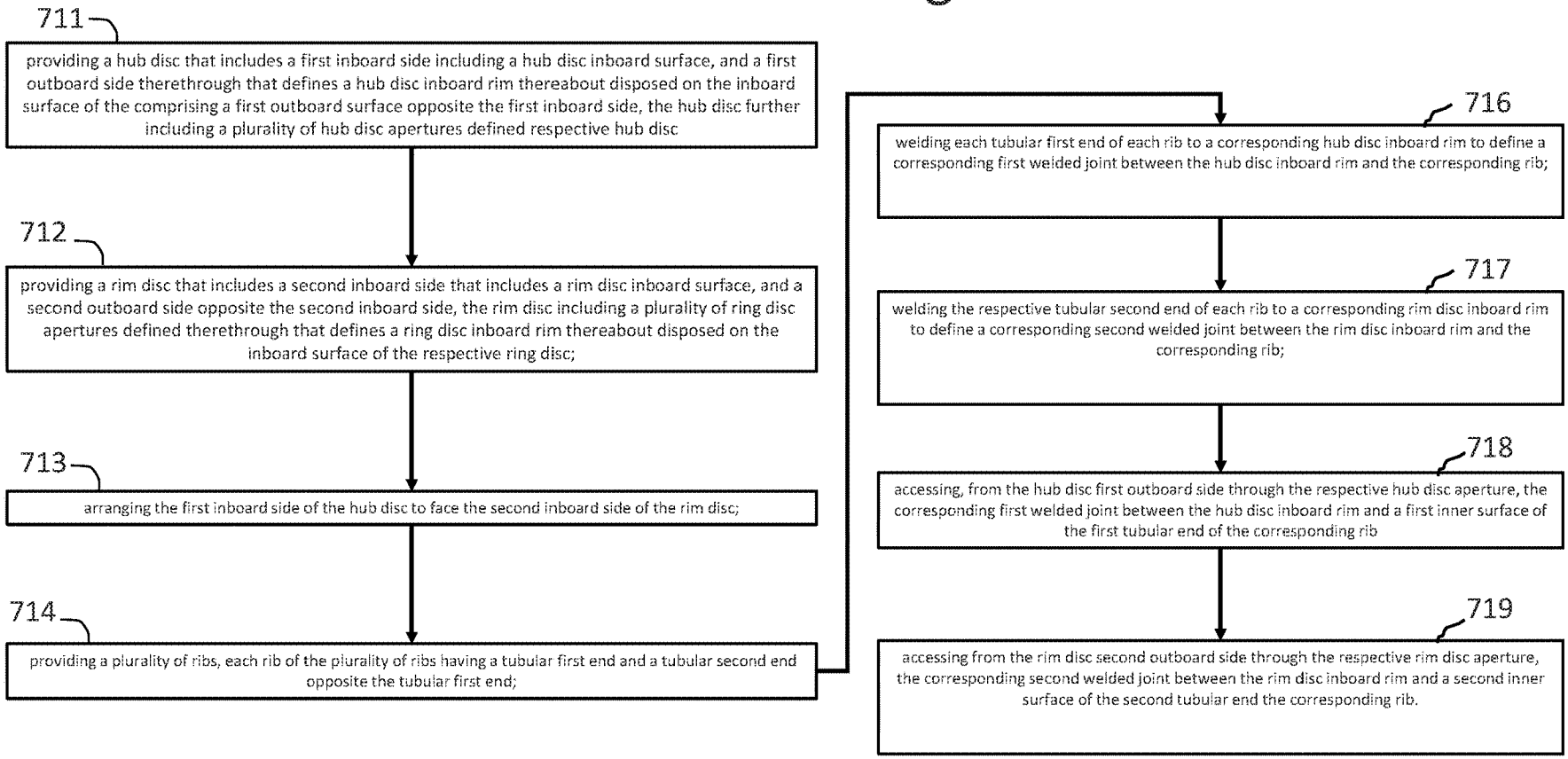
FIG. 9. is a flow chart of a method of assembly of a beater wheel in accordance with an embodiment.

In other embodiments, as illustrated in FIG. 7, the first and second ends 61, 62 of each rib 60 may be bifurcated, or otherwise arranged to have a respective plurality of first and second ends 61, 62 ends formed as tubes and which are welded to the respective hub disc 141 and ring disc 142 at the distal end of each respective tube. For example, in such an embodiment, each rib 60 may have a plurality of first tubular ends 61*a* and a plurality of opposing second tubular ends 62*a*. Each of the plurality of first tubular ends 61*a* may be of tubular construction and define a corresponding first outer surface 61*b* thereon and a corresponding first inner tube surface 61*c* therein. In an embodiment, each of the plurality of opposing second tubular ends 62*a* may be of tubular construction and further define a corresponding second outer surface 62*b* thereon and a corresponding second inner surface 62*c* therein. A first gap 63*a* is defined between each corresponding first tubular end 61*a*, and a second gap 63*b* is defined between each corresponding second tubular end 61*b*. Each of the plurality of the first and second tubular ends 61*a*, 62*a* may each be constructed in the form of a hollow tube, wherein the corresponding first and second outer surfaces 61*b*, 62*b*, define the respective tube outer walls, and the first and second inner surfaces 61*c*, 62*c*, define the respective tube inner walls. It will be understood, that in FIG. 7, the rib 60 is depicted as having two first tubular ends 61*a*, and two second tubular ends, other embodiments are not so limited, and each rib 60 may comprise any number of first and second tubular ends 61*a*, 62*a* that enables the invention to function as intended.

In various embodiments, beater plates 66 are mounted on ribs 60. The beater plates 66 may be arranged as single and multiple-part beater plate sets corresponding to and coupled to each rib 60. For example, in operation, a solid fuel such as coal is fed into a circumferential rim region of the rotating beater wheel 40 and is comminuted by the beater plates 66 coupled to the ribs 60 extending between the first hub disc 141 and ring disc 142. In an embodiment, the beater plates 66 are further disposed along the radially outer part of the beater wheel hub disc 141 and the beater wheel ring disc 142 and weldingly coupled to a respective rib 60.

The hub disc 141 includes a plurality of hub disc apertures 71 defined therethrough, and radially distributed about the circumference of the hub disc 141. In an embodiment, each hub disc aperture 71 of the plurality of hub disc apertures 71 corresponds to at least one rib 60. Likewise, the ring disc 142 includes a plurality of ring disc apertures 72 defined therethrough, and radially distributed about the circumference of the ring disc 142. In an embodiment, each ring disc aperture 72 of the plurality of ring disc apertures 72 corresponds to at least one rib 60.

In an embodiment, each hub disc aperture 71 defines a respective hub disc inboard rim 75 thereabout on the inboard side 112 of the hub disc 141. In an embodiment, each hub disc inboard rim 75 is defined on the first inboard face 112*a* of the hub disc 141 thereabout a respective hub disc aperture 71. In an embodiment, each ring disc aperture 72 defines a respective ring disc inboard rim 76 thereabout on the second inboard side 121 of the respective ring disc 142 In an embodiment, each ring disc inboard rim 76 is defined on the second inboard face 121*a* of the ring disc 142 thereabout a respective ring disc aperture 72. In certain embodiments, each hub disc inboard rim 75 may be flush with, or disposed thereon, the respective hub disc inboard face 112*a*. In an embodiment, each ring disc inboard rim 76 may be flush with, or disposed thereon, the respective ring disc inboard face 121*a*. In other embodiments, at least one of the hub disc inboard rim 75 may comprise a separate surface from the respective hub disc inboard face 112*a*, and at least one of the ring disc inboard rim 76 may comprise a separate surface from the respective ring disc inboard face 121*a*. In still other embodiments, at least one of the hub disc inboard rim 75 and the ring disc inboard rim 76 may be recessed from, or below, the respective hub disc inboard face 112*a* and respective ring disc inboard face 121*a*.

In an embodiment, the first end 61 of each rib 60 is weldingly coupled to a corresponding hub disc inboard rim 75 to thereby define a respective first weld joint 78 therebetween. It will be appreciated that each respective first weld joint 78 will define a weld region or seam thereat. For example, in an embodiment, the first weld joint 78 will have a weld region or seam disposed between the respective first inner tube surface 61*c* and the hub disc inboard rim 75. Similarly, in an embodiment, the second end 62 of each rib is weldingly coupled to a respective ring disc inboard rim 76 to thereby define a respective second weld joint 79 therebetween. It will be appreciated that the second weld joint 79 will also define a weld region or seam thereat. For example, in an embodiment, each respective second weld joint 79 will have a weld region or seam disposed between the respective second inner tube surface 62*c* and the ring disc inboard rim 76.

Each hub disc aperture 71 is sized and disposed to enable direct access therethrough, from the hub disc first outboard side 111, to the respective first weld joint 78 between the hub disc inboard rim 75 and first inner surface 61*c* of the corresponding rib 60 Likewise, in an embodiment, each ring disc aperture 72 is sized and disposed to enable direct access therethrough, from the ring disc second outboard side 122, to the respective second weld joint 79 disposed between the respective ring disc inboard rim 76 and second inner surface 62*c* of the respective rib 60. For example, it will be appreciated that during assembly of a pulverizer mill, each respective first weld joint 78, between the first end 61 of each rib 60 and the respective hub disc inboard rim 75, may readily be accessed for non-destructive testing and inspection from the hub disc first outboard side 111, through the respective aperture 71, to the corresponding weld joint 78. For example, the weld region or seam defined by each first welded joint 78 may be inspected by accessing the weld joint 78 from the hub disc first outboard side 111, through the respective aperture 71. It will also likewise be appreciated that, during assembly of the pulverizer mill, each second weld joint 79, between the second end 62 of each rib 60 and the respective ring disc inboard rim 76, may readily be accessed for non-destructive testing and inspection from the ring disc second outboard side 122, through the respective aperture 72, to the corresponding hub weld joint 79. For example, the weld region or seam defined by each second weld joint 79 may be inspected by accessing from the rim disc second outboard side 122, through the respective aperture 72.

In another embodiment, a method of assembling a pulverizer wheel is provided. In an embodiment, the method comprises, at step 711, providing a hub disc 141 that includes a first inboard side 112 including a hub disc inboard face 112*a*, and a first outboard side 111 comprising a first outboard face 111*a* opposite the first inboard side 112, the hub disc 141 further including a plurality of hub disc apertures 71 defined therethrough, where each hub disc aperture 71 defines a respective hub disc inboard rim 75 thereabout disposed on the inboard face 112*a* of the respective hub disc 141. In an embodiment, the hub disc apertures 71 may be radially distributed about a circumference of the hub disc 141.

At step 712, providing a ring disc 142 that includes a second inboard side 121 that includes a ring disc inboard surface 121*a,* and a second outboard side 122 opposite the second inboard side 121, the ring disc including a plurality of ring disc apertures 72 defined therethrough, where each ring disc aperture 71 defines a respective ring disc inboard rim 76 thereabout disposed on the inboard face 121*a* of the respective ring disc 142. In an embodiment, the plurality of ring disc apertures 72 may be radially distributed about a circumference of the ring disc 142.

At 713, arranging the first inboard side 112 of the hub disc 141 to face the first inboard side 121 of the ring disc 142.

At step 714, providing a plurality of web elements or ribs 60, each rib 60 having a first end 61 and a second end 62 opposite the first end. An embodiment, may include step 715, radially distributing the plurality of ribs 60 around the circumference of the beater wheel 40 at regular intervals.

At step 716, welding the first end 61 of each rib 60 to a respective hub disc inboard rim 75 to define a respective first welded joint 78 between the respective hub disc inboard rim 75 and the respective rib 60.

At step 717, welding the second end 61 of each rib 60 to a respective ring disc inboard rim 76 to define a respective second welded joint 79 between the respective ring disc inboard rim 76 and the respective rib 60.

At step 718, accessing, from the hub disc first outboard side 111 through the respective hub disc aperture 71, the corresponding first welded joint 78 between the hub disc inboard rim 75 and the corresponding rib 60.

Step 719, accessing from the ring disc second outboard side 122 through the respective ring disc aperture 72, the corresponding welded joint 79 between the ring disc inboard rim 76 of the corresponding rib 60.

In an embodiment at step 720, inspecting the welded joint 78 through the respective hub disc aperture 71, for example by performing non-destructive testing on the welded joint 78.

In an embodiment at step 721, inspecting the welded joint 79 through the respective ring disc aperture 72, for example by performing non-destructive testing on the welded joint 78.

Some embodiments further include, at step 723, coupling hub disc 141 to an axle 33 having a longitudinal axis of rotation "A", such that a rotation of the axle 33 thereby causes rotation of bub disc 141 and ring disc 142 about axis "A". At step 724, rotating the hub disc 141 and ring disc 142 about a common axis "A", in a common direction.

Other embodiments may include, at step 724, coupling a corresponding beater plate 66 to each respective rib 60 of the plurality of ribs. For example, in an embodiment, each beater plate 66 may be coupled by bolting or welding to the respective rib 60.

Accordingly, some embodiments of the invention eliminate the need for bolted joint coupling between the beater plate ribs and the hub and ring discs.

Further, by providing for welded joints between the beater plate ribs and the hub and ring discs, some embodiments of the present invention provide for the ability to test and inspect the welded joints from the outboard sides of the hub and ring disc respectively, and through apertures disposed therethrough, and without the need for disassembly of parts.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "above," "below," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. A pulverizer mill comprising:

a hub disc defining a first inboard face and an a first outboard face opposite the first inboard face, the hub disc having a first plurality of apertures defined therethrough, each aperture of the first plurality of apertures defining a respective first inboard rim thereabout on the first inboard face;

a ring disc spaced therefrom the hub disc, defining a second inboard face and a second outboard face and opposite the second inboard face, the second inboard face facing the first inboard face and spaced therefrom, the ring disc having a second plurality of apertures defined therethrough, each aperture of the second plurality of apertures defining a respective second inboard rim thereabout on the second inboard face;

a plurality of ribs extending therebetween the hub disc first inboard face and the ring disc second inboard face;

each rib of the plurality of ribs having a first end and an opposing second end, wherein, each first end of each rib of the plurality of ribs is weldingly coupled to a respective first inboard rim to define a respective first joint therebetween;

each opposing second end of each rib of the plurality of ribs is weldingly coupled to a respective second inboard rim to define a respective second joint therebetween.

2. The pulverizer mill of claim 1, wherein:

each respective aperture of the first plurality of apertures is sized and disposed to enable access therethrough to the respective first joint; and each respective aperture of the second plurality of apertures is sized and disposed to enable access therethrough to the respective second joint.

3. The pulverizer mill of claim 2, wherein:

each first end of each rib of the plurality of ribs is tubular, defining a respective first internal tube wall therein; and each opposing second end of each rib of the plurality of ribs is tubular, defining a respective second internal tube wall therein.

4. The pulverizer mill of claim 3, wherein:

each respective first joint is defined between the respective first internal wall of the first end of each respective rib and the respective first inboard rim; and each respective second joint is defined between the second internal wall of the second end of each respective rib and the respective second inboard rim.

5. The pulverizer mill of claim 4, wherein:

wherein each respective aperture of the first plurality of apertures is sized and disposed to enable access therethrough to the respective first joint; and each respective aperture of the second plurality of apertures is sized and disposed to enable access therethrough to the respective second joint.

6. The pulverizer mill of claim 3, wherein:

wherein each respective aperture of the first plurality of apertures is sized and disposed to enable access therethrough to the first inner tube wall of the respective rib; and each respective aperture of the second plurality of apertures is sized and disposed to enable access therethrough to the second inner surface of the respective rib.

7. The pulverizer mill of claim 1, wherein the hub disc is coupled to a rotatable axle defining a longitudinal axis therethrough, and operative to rotate about the longitudinal axis.

8. The pulverizer mill of claim 1, wherein the first plurality of apertures are radially distributed about a circumference of the hub disc.

9. The pulverizer mill of claim 1, wherein the second plurality of apertures are radially distributed about a circumference of the ring disc.

10. The pulverizer mill of claim 1, wherein the hub disc and the ring disc are operative to rotate about the same axis in the same direction.

11. The pulverizer mill of claim 1, wherein the first and second ends of each rib of the plurality of ribs are bifurcated, to thereby define a respective plurality of first ends and a respective plurality of second ends of each respective rib of the plurality of ribs.

12. The pulverizer mill of claim 11, wherein each first end of the respective plurality of first ends of each rib is tubular and defines a respective first internal tube wall therein, and each second end of the respective plurality of second ends of each rib is tubular and defines a respective second internal tube wall therein.

13. The pulverizer mill of claim 12, wherein each respective aperture of the first plurality of apertures is sized and disposed to enable access therethrough to the first inner tube wall of the respective rib; and each respective aperture of the second plurality of apertures is sized and disposed to enable access therethrough to the second inner surface of the respective rib.

14. The pulverizer mill of claim 12, wherein each respective aperture of the first plurality of apertures is sized and disposed to enable access therethrough to the respective first joint; and each respective aperture of the second plurality of apertures is sized and disposed to enable access therethrough to the respective second joint.

15. A method of making a pulverizer mill comprising:

providing a hub disc that includes a first inboard side having a hub disc inboard face, and a first outboard side comprising a first outboard face opposite the first inboard side, the hub disc further including a plurality of hub disc apertures defined therethrough, each aperture of the plurality of hub disc apertures defining a respective hub disc inboard rim thereabout disposed on the inboard face of the hub disc;

providing a ring disc that includes a second inboard side that includes a ring disc inboard face, and a second outboard side opposite the second inboard side, the ring disc including a plurality of ring disc apertures defined therethrough that defines a ring disc inboard rim thereabout disposed on the inboard face of the respective ring disc;

arranging the first inboard side of the hub disc to face the second inboard side of the ring disc;

providing a plurality of ribs, each rib of the plurality of ribs having a tubular first end and a tubular second end opposite the tubular first end, the first tubular end having a first outer surface thereon and a first inner surface therein and the opposing second tubular end having a second outer surface thereon and a second inner surface therein;

welding each tubular first end of each rib to the hub disc first inboard side to define a respective first welded joint therebetween the first inboard face of the hub disc inboard rim and the first inner surface of the first tubular end of the respective rib;

welding the respective tubular second end of each rib to the ring disc second inboard side to define a respective ponding second welded joint there between the second inboard face of the ring disc inboard rim and the second inner face of the second tubular end of the respective rib;

accessing, from the hub disc first outboard side through the respective hub disc aperture, the respective first welded joint between the hub disc inboard rim and the first inner surface of the first tubular end of the respective rib; and accessing from the ring disc second outboard side through the respective ring disc aperture, the respective second welded joint between the ring disc inboard rim and the second inner surface of the second tubular end the respective rib.

16. The method of claim 15, further including the step of inspecting each first welded joint through the respective hub disc aperture.

17. The method of claim 15, further including the step of inspecting each second welded joint through the respective ring disc aperture.

18. The method of claim 15, further including the step of radially distributing the plurality of ribs around the circumference of the beater wheel at regular intervals.

19. The method of claim 15, further including the step of coupling the hub disc to an axle having a longitudinal axis that defines an axis of rotation for the beater wheel.

20. The method of claim 15 further including the step of coupling a beater plate to each rib of the plurality of ribs.

* * * * *